United States Patent [19]

Bage et al.

[11] 4,079,213

[45] Mar. 14, 1978

[54] PIEZOELECTRIC TRANSDUCER HAVING IMPROVED LOW FREQUENCY RESPONSE

[75] Inventors: Jeffery T. Bage, Euclid; Kenneth R. Cowles, Mentor; Paul D. Montgomery, Willoughby, all of Ohio

[73] Assignee: Essex Group, Inc., Fort Wayne, Ind.

[21] Appl. No.: 789,754

[22] Filed: Apr. 21, 1977

[51] Int. Cl.[2] ..... H04R 17/00

[52] U.S. Cl. ..... 179/110 A; 179/181 F

[58] Field of Search ..... 179/110 A

*Primary Examiner*—George G. Stellar

*Attorney, Agent, or Firm*—Lawrence E. Freiburger; Robert D. Sommer

[57] ABSTRACT

A transducer assembly for converting electrical energy into acoustical energy and vice versa in which a single multi-layer piezoelectric transducer drives (or is driven) a flat diaphragm secured at its edges in a housing. The piezoelectric transducer is a multi-layer wafer which is secured to a flexible sheet which in turn is secured over an aperture in the diaphragm. The piezoelectric multi-layer wafer has its central portion constrained from movement which increases its edgewise movement to twice its unconstrained value. The movement constraint is provided by a post on the housing which is cemented to a central aperture in the wafer. It has been found that there is a maximum ratio of the post diameter to the wafer diameter for optimum performance of the speaker.

5 Claims, 11 Drawing Figures

PIEZOELECTRIC TRANSDUCER HAVING IMPROVED LOW FREQUENCY RESPONSE

BACKGROUND OF THE INVENTION

Piezoelectric devices have long been known which convert electrical signals into motion. In particular, loudspeakers constructed of a flat plate and driven by piezoelectric wafers mounted on the plate are well known in the art as exemplified by the device disclosed in Kompanek U.S. Pat. No. 3,423,543. This type of device suffers from a major shortcoming in that adequate low frequency response cannot be achieved without using multiple drivers and/or a large radiating surface area.

Spitzer et al U.S. Pat. No. 2,911,484 discloses an electro-acoustic transducer in FIGS. 3 and 4 which has a diaphragm, a housing to which the diaphragm is mounted, a plurality of curved piezoelectric wafers mounted so that their peripheral edge is cemented to the underside of the diaphragm and their central portions are cemented to a boss on the housing. Spitzer et al makes it clear in their specification that a plurality of driving elements is necessary to achieve low frequency response. No teaching is found in Spitzer et al relating to the optimal size for the boss.

U.S. Pat. No. 3,721,840, Yamada, discloses a sound generator having a relatively thin diaphragm and a piezoelectric monomorph disc adhered to a metallic substrate which is adhered to the diaphragm over an aperture therein.

SUMMARY OF THE INVENTION

It is thus an object of the present invention to provide a transducer for converting electrical energy into acoustic energy in which a single multi-layer piezoelectric transducer is attached to a flat diaphragm so that movement of the single multi-layer piezoelectric driver causes movement of the diaphragm to produce sound and in which the low frequency response of such device is within reasonable limits.

This object as well as others which will become apparent as the description of the invention proceeds are accomplished by the transducer structure of the invention in which a single multi-layer flat piezoelectric driver is affixed to a flat diaphragm and the center of the driver is constrained from moving. The movement constraint has the resultant effect of increasing the edgewise movement of the multi-layer piezoelectric driver to twice the unconstrained value which results in improved low frequency response. One way of providing the movement constraint is to cement a post on the housing into an aperture in the center of the multi-layer piezoelectric driver. It has been found that performance of the transducer falls off if the diameter of the post is too large relative to the diameter of the driver. Thus, the ratio of the post diameter to the driver diameter should not exceed a certain value.

BRIEF DESCRIPTION OF THE DRAWINGS

In the course of the detailed description of the invention, reference will be made to the drawings in which.

DETAILED DESCRIPTION OF THE INVENTION

Figure 1:
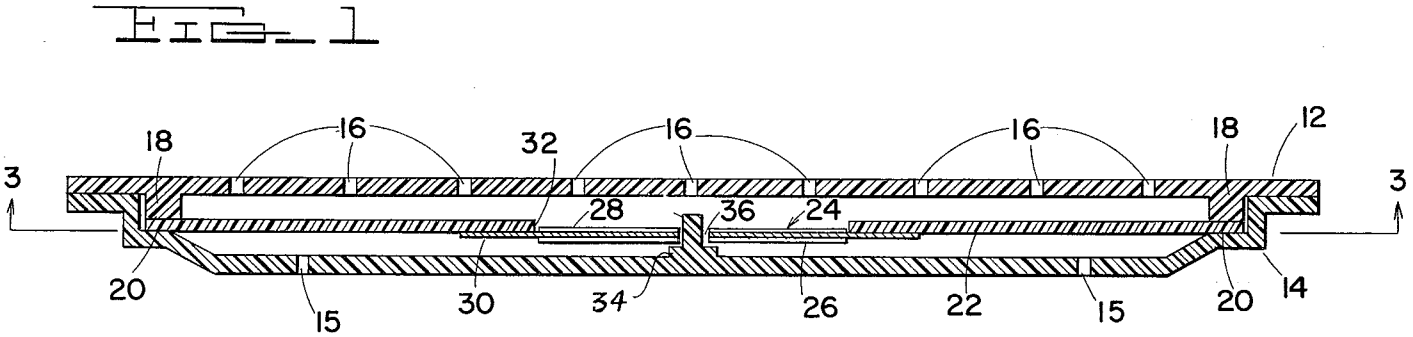
FIG. 1 is a cross sectional view of a piezoelectric transducer assembly in accordance with the invention.
Figure 3:
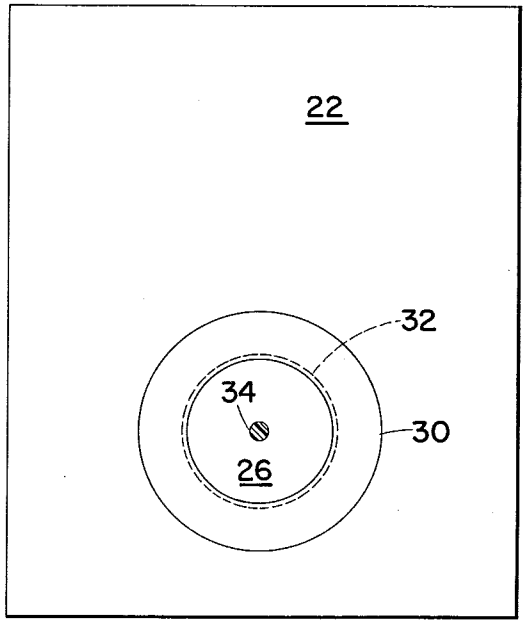
FIG. 3 is a view taken along lines 3—3 of FIG. 1.
Figure 2:
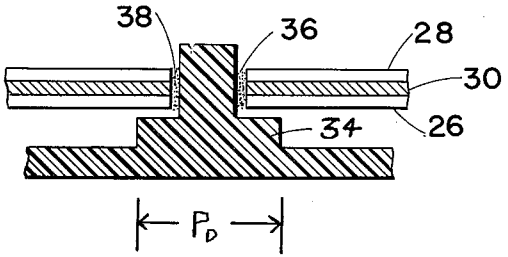
FIG. 2 is a cross sectional view of a portion of the assembly of FIG. 1.

Referring now to the drawings, a piezoelectric loudspeaker assembly in accordance with the present invention includes a housing having an upper housing section 12 and a lower housing section 14 which form an enclosure for the speaker assembly. The two housing sections 12 and 14 can be molded of a relatively rigid plastic material. The upper housing section has a plurality of apertures 16 therein which can be arranged in a decorative pattern and which serve to allow radiation of sound from the housing. It will be seen that the two housing sections are secured to one another around their periphery. This securement may be effected by any suitable means, some of which are adhesive attachment, spring clips, threaded fasteners, or the two housing sections may be designed to latch together by integral latches. Pressure relief apertures 15 are provided in the lower housing section 14.

The upper housing 12 has a peripheral rib 18 extending into the cavity formed by the housing which cooperates with a corresponding ledge 20 on the lower housing section 14 to entrap the peripheral edge of a rectangular diaphragm 22 between them. The housing thus provides a mounting for the diaphragm 22 and if deemed necessary, additional means such as an adhesive may be employed to ensure a secure mounting for the diaphragm. A preferred material from which the diaphragm may be constructed is a Polysulfone foam since this material can withstand a relatively wide range of temperatures. Other materials may also be used if desired.

As shown in the drawings, the diaphragm is rectangular and has a driver assembly generally indicated by reference numeral 24 attached to it at a non-central mounting. It has been found that for some shapes and sizes of diaphragms, a non-central driver mounting results in slightly better performance, while for other sizes and shapes, the position of the driver seems to make no difference. Thus, the optimal position of the driver does not appear to be precisely related to the size and/or shape of the diaphragm, and it appears to be necessary to determine the optimal position by experimentation.

The driver assembly 24 is known in the art as a series type bimorph and includes two circular piezoelectric wafers 26 and 28 which are secured together in a stacked relationship with one another by a flexible circular interelectrode 30 which is of larger diameter than the piezoelectric wafers 26 and 28. The construction and operation of the series type bimorph driver assembly 24 is well known in the art. It should therefore suffice to say that upon application of electrical energy at the electrodes of the assembly (not shown), the bimorph driver 24 will distort to produce movement.

Driver assembly 24 is secured together by a flexible conductive adhesive as is well known in the art. In the same manner, the interelectrode 30 is adhesively attached with a non-conductive adhesive to the underside of the diaphragm in such a manner that the upper piezoelectric wafer 28 is situated within an aperture 32 in diaphragm 22. By way of example, the upper and lower piezoelectric wafers 28 and 26 may be formed from a 7.5 mil thick PZT5H piezoelectric crystal available from Vernitron Piezoelectric Division, and the interelectrode 30 may be constructed of a 2 mil thick half hard brass material. It will be clear to those skilled in the art that other commonly known piezoelectric crystals as well as other materials for the interelectrode may be used as well.

In accordance with the present invention, the lower housing section includes an integral constraining post 34 which extends axially into an aperture 36 in the center of the driver assembly 24. A suitable adhesive 38 is used to attach the post 34 to the aperture 36 in the driver assembly 24. It will be clear that although the post 34 is disclosed as being integral with the lower housing section 14, a separate post attached to the housing will accomplish the same function. The diameter $P_D$ of the post 34 in relation to the diameter of the driver element 26 has been found to be a fairly critical dimensional relationship in order to provide optimum speaker performance. More specifically, it has experimentally been determined that for optimum performance of the speaker the post area in contact with the transducer must not exceed 10 percent of the area of the piezoelectric element.

Figure 6A:
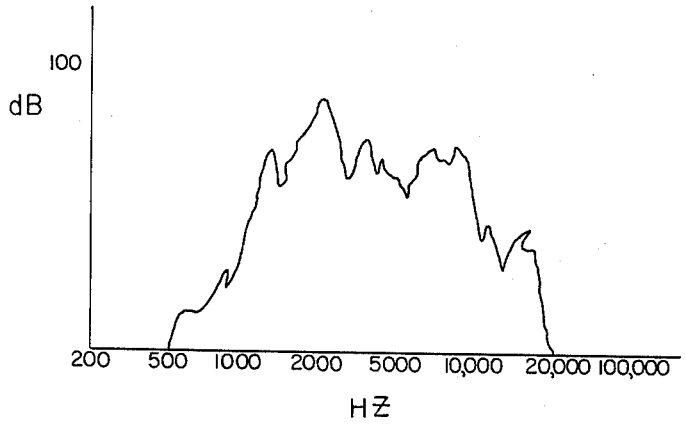
FIGS. 6A and 6B are schematic illustrations which serve to illustrate the effect different post diameter to wafer diameter ratios have on frequency response of the transducer.
Figure 6B:
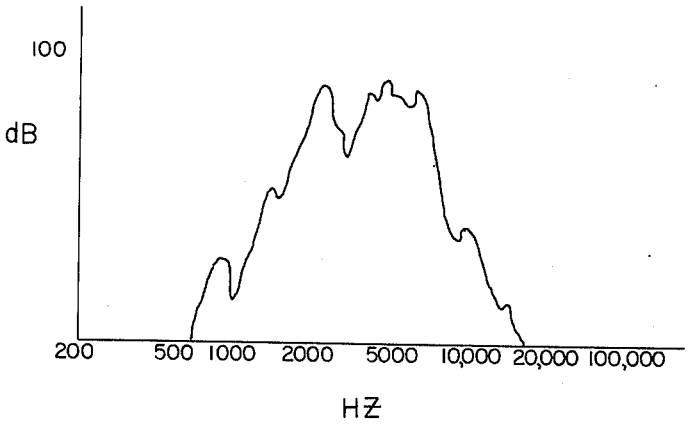

An alternate way of stating this relationship is that the post diameter $P_D$, to driver diameter ratio should not exceed 0.316 in order to obtain optimal performance from the speaker. As the ratio is increased above 0.316 it has experimentally been determined that the overall frequency response of the transducer falls off. In order to exemplify this reference will now be made to FIGS. 6A and 6B. The data shown in FIG. 6A plots sound volume (in dB) against frequency for a transducer having a post diameter of 0.312. It will be seen that over the interval between 1000 and 10,000 Hz the response is fairly flat. In FIG. 6B, the post diameter has been increased to 0.500 and all other dimensions remain the same. It will now be seen that the frequency response remains flat over the range of 2500 of 7000 Hz.

Figure 4A:
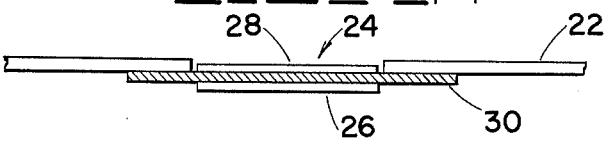
FIGS. 4A, 4B, and 4C are schematic illustrations showing movement of a transducer without the movement constraint of the invention.
Figure 4B:
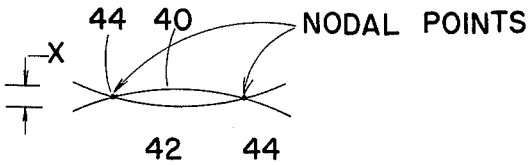
Figure 4C:
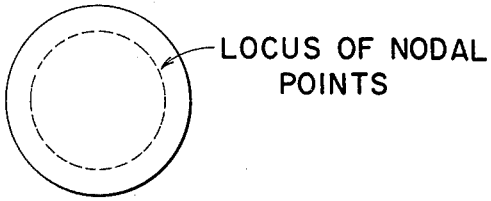

By now it is believed the operation of the device should be clear to those skilled in the art but for sake of clarity its operation will briefly be described. Referring firstly to FIGS. 4A–4C, operation of a prior art device is schematically illustrated. When an a.c. sound signal of the appropriate frequency is applied to piezoelectric driver assembly 24, the bimorph will cup and therefore oscillate between the two positions indicated by reference numerals 40, 42 in FIG. 4B. The points indicated by reference numeral 44 on FIG. 4B will not move. Thus movement of this system will result in a locus of nodal points which is a ring concentric with the wafer as indicated in FIG. 4C. The movement will also result in an edgewise movement of the wafer which is labeled X.

Figure 5A:
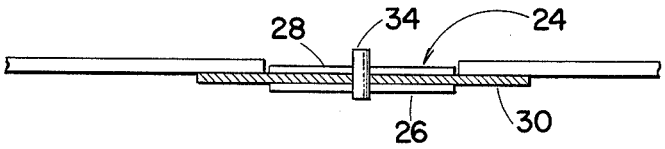
FIGS. 5A, 5B, and 5C are schematic illustrations similar to FIGS. 4A, 4B and 4C showing movement of the transducer with the constraint of the invention.
Figure 5B:
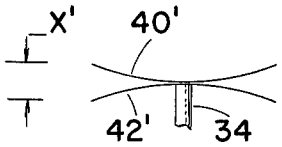
Figure 5C:
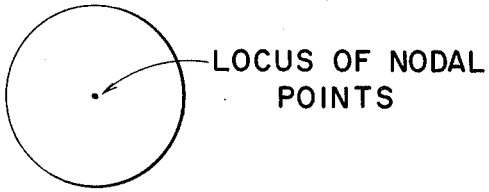

In FIGS. 5A–5C, however, the post constraint 34 of the invention is introduced, and thus, the center of the piezoelectric driver assembly is prevented from moving. By constraining movement of the center of driver assembly 24, the bimorph still cups or oscillates, but it now oscillates between the two positions indicated in FIG. 5B by reference numerals 40′, 42′ with a total edgewise displacement of X′. Thus, the locus of nodal points has essentially been moved to the exact center of the bimorph, and the total edgewise displacement is twice the unconstrained value ($X'=2X$). This, of course, imparts greater movement to the diaphragm 22 in the constrained condition than in the unconstrained condition. The effect of greater edgewise movement of the driver assembly 24 is also coupled to the diaphragm 22. Thus, at the given frequency, the effect of the constraint has been to increase the movement of the diaphragm which in turn increases the acoustic radiation amplitude of the device.

It is contemplated that modifications will occur to those skilled in the art. Accordingly, it is intended that the claims define the invention as broadly as possible.

What is claimed is:

1. A transducer assembly for converting acoustic energy into electrical energy or for converting electrical energy into acoustic energy, which comprises:

a housing;

a flexible diaphragm mounted in said housing with its non-peripheral portion substantially free for movement, and an aperture in said non-peripheral portion;

a flexible sheet overlying said aperture and secured to said diaphragm;

a single piezoelectric multi-layer wafer secured to said flexible sheet, said piezoelectric multi-layer wafer having a central portion and a peripheral edge portion; and movement constraining means on said housing for preventing movement of said central portion whereby movement of said multi-layer wafer is restricted to said edge portion.

2. The transducer assembly as claimed in claim 1 wherein said flexible sheet is secured between two adjacent layers of said multi-layer wafer.

3. The transducer assembly as claimed in claim 1 wherein said movement constraining means comprises:

a rigid post mounted at one end on said housing and secured to said central portion at said other end.

4. The transducer assembly as claimed in claim 3 wherein said rigid post extends into a central aperture in said piezoelectric multi-layer wafer and is secured by adhesive.

5. The transducer assembly as claimed in claim 4 wherein the ratio of the post contact area to wafer area is less than 10%.

* * * * *